US010695899B2

(12) United States Patent
Scott

(10) Patent No.: US 10,695,899 B2
(45) Date of Patent: Jun. 30, 2020

(54) GAS SPRING FASTENER DRIVER

(71) Applicant: TTI (MACAO COMMERCIAL OFFSHORE) LIMITED, Macau (MO)

(72) Inventor: Zachary Scott, Pendleton, SC (US)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 415 days.

(21) Appl. No.: 15/614,775

(22) Filed: Jun. 6, 2017

(65) Prior Publication Data

US 2017/0355069 A1 Dec. 14, 2017

Related U.S. Application Data

(60) Provisional application No. 62/347,230, filed on Jun. 8, 2016.

(51) Int. Cl.

| | |
|---|---|
| ***B25C 1/06*** | (2006.01) |
| ***B25C 1/04*** | (2006.01) |
| ***B25C 5/13*** | (2006.01) |

(52) U.S. Cl.

CPC ..... *B25C 1/041* (2013.01); *B25C 1/047* (2013.01); *B25C 1/06* (2013.01); *B25C 5/13* (2013.01); *B25C 1/04* (2013.01)

(58) Field of Classification Search

CPC .. B25C 1/00; B25C 1/04; B25C 1/041; B25C 1/047; B25C 1/06; B25C 1/08; B25C 1/042; B25C 5/13

USPC ..... 227/131, 130, 132, 134, 10, 8, 146; 173/124, 122, 205, 204, 121, 201, 203, 173/162.1

See application file for complete search history.

(56) References Cited

U.S. PATENT DOCUMENTS

| | | | | | |
|---|---|---|---|---|---|
| 2,857,596 | A | * | 10/1958 | Allen | B25C 1/04 227/123 |
| 3,203,610 | A | * | 8/1965 | Farrell | B25C 1/06 227/146 |
| 3,278,103 | A | | 10/1966 | Juilfs | |
| 3,299,967 | A | * | 1/1967 | Cabot | B25C 1/06 173/201 |
| 3,809,307 | A | | 5/1974 | Wandel | |
| 3,858,780 | A | | 1/1975 | Perkins | |
| 3,871,566 | A | | 3/1975 | Elliesen | |
| 3,913,685 | A | * | 10/1975 | Enstrom | B25C 1/06 173/117 |

(Continued)

FOREIGN PATENT DOCUMENTS

WO WO-2005095063 A1 10/2005

*Primary Examiner* — Scott A Smith

(74) *Attorney, Agent, or Firm* — Michael Best & Friedrich LLP

(57) ABSTRACT

A fastener driver includes a main housing, a drive blade movable from a retracted position to a driven position for driving a fastener into a workpiece, and a gas spring mechanism for driving the drive blade from the retracted position to the driven position. The gas spring mechanism includes a piston movable between a retracted position and a driven position. The fastener driver also includes an extensible cylinder for moving the drive blade from the driven position toward the retracted position. The extensible cylinder includes a cylinder housing coupled one of the main housing or the drive blade, and a rod coupled to the other of the main housing or the drive blade. A vacuum is created in the cylinder housing for biasing the drive blade toward the retracted position.

21 Claims, 10 Drawing Sheets

(56) References Cited

U.S. PATENT DOCUMENTS 3,940,044 A 2/1976 Lapointe
3,948,426 A 4/1976 La Pointe
4,122,904 A 10/1978 Haytayan
4,215,808 A 8/1980 Sollberger
4,227,637 A 10/1980 Haytayan
4,260,092 A 4/1981 Austin
4,339,065 A 7/1982 Haytayan
4,346,831 A 8/1982 Haytayan
4,384,668 A 5/1983 Tutomu
4,452,387 A 6/1984 Haytayan
4,610,381 A * 9/1986 Kramer ..... B25C 1/005 227/120
RE32,452 E 7/1987 Nikolich
4,821,938 A 4/1989 Haytayan
4,909,419 A 3/1990 Yamada
5,020,712 A 6/1991 Monacelli
5,437,339 A * 8/1995 Tanaka ..... B25C 1/047 173/210
5,511,715 A 4/1996 Crutcher
5,645,208 A 7/1997 Haytayan
5,683,024 A 11/1997 Eminger
5,720,423 A 2/1998 Kondo
5,921,156 A 7/1999 Takezaki
5,927,585 A * 7/1999 Moorman ..... B25C 5/15 173/203
6,145,724 A 11/2000 Shkolnikov
6,318,615 B1 11/2001 Walter
6,488,195 B2 * 12/2002 White ..... B25C 1/003 173/201
RE38,834 E 10/2005 Perra
7,073,468 B2 7/2006 Akiba
7,137,540 B2 11/2006 Terrell
7,290,691 B1 11/2007 Wen
7,469,811 B2 * 12/2008 Shima ..... B25C 1/06 227/131
7,490,747 B2 2/2009 Kitagawa
7,686,197 B2 3/2010 Kosuge
7,938,305 B2 * 5/2011 Simonelli ..... B25C 1/06 227/129
8,011,441 B2 9/2011 Leimbach
8,011,547 B2 9/2011 Leimbach
8,230,941 B2 7/2012 Leimbach
8,267,296 B2 9/2012 Leimbach
8,267,297 B2 9/2012 Leimbach
8,286,722 B2 10/2012 Leimbach
8,387,718 B2 3/2013 Leimbach
8,505,798 B2 * 8/2013 Simonelli ..... B25C 1/008 173/162.1
8,602,282 B2 12/2013 Leimbach
8,763,874 B2 7/2014 McCardle
8,875,969 B2 11/2014 Pedicini
8,960,516 B2 * 2/2015 Iijima ..... B25B 21/023 227/10
9,216,502 B2 * 12/2015 Brendel ..... B25C 1/06
9,539,714 B1 1/2017 Pedicini
9,636,812 B2 * 5/2017 Pedicini ..... B25C 1/047
9,962,821 B2 * 5/2018 Pedicini ..... B25C 1/06
10,173,310 B2 * 1/2019 Wyler ..... B25C 1/06
2005/0156008 A1 7/2005 Komazaki
2005/0218176 A1 10/2005 Schell
2006/0261127 A1 11/2006 Wolf
2011/0108600 A1 * 5/2011 Pedicini ..... B25C 1/047 227/2
2014/0069671 A1 3/2014 Leimbach
2016/0229043 A1 * 8/2016 Wyler ..... B25C 1/06
2016/0288305 A1 10/2016 McCardle
2017/0274513 A1 9/2017 Pedicini et al.
2018/0290279 A1 * 10/2018 Kobori ..... B25C 1/047

* cited by examiner

GAS SPRING FASTENER DRIVER

CROSS-REFERENCE TO RELATED APPLICATIONS

This application claims priority to U.S. Provisional Patent Application No. 62/347,230 filed on Jun. 8, 2016, the entire content of which is incorporated herein by reference.

FIELD OF THE INVENTION

The present invention relates to power tools, and more particularly to gas spring fastener drivers.

BACKGROUND OF THE INVENTION

There are various fastener drivers used to drive fasteners (e.g., nails, tacks, staples, etc.) into a workpiece known in the art. These fastener drivers operate utilizing various means (e.g., compressed air generated by an air compressor, electrical energy, flywheel mechanisms) known in the art, but often these designs are met with power, size, and cost constraints.

SUMMARY OF THE INVENTION

The present invention provides, in one aspect, a fastener driver including a main housing, a drive blade movable from a retracted position to a driven position for driving a fastener into a workpiece, and a gas spring mechanism for driving the drive blade from the retracted position to the driven position. The gas spring mechanism includes a piston movable between a retracted position and a driven position. The fastener driver also includes an extensible cylinder for moving the drive blade from the driven position toward the retracted position. The extensible cylinder includes a cylinder housing coupled one of the main housing or the drive blade, and a rod coupled to the other of the main housing or the drive blade. A vacuum is created in the cylinder housing for biasing the drive blade toward the retracted position.

Other features and aspects of the invention will become apparent by consideration of the following detailed description and accompanying drawings.

Figure 1:
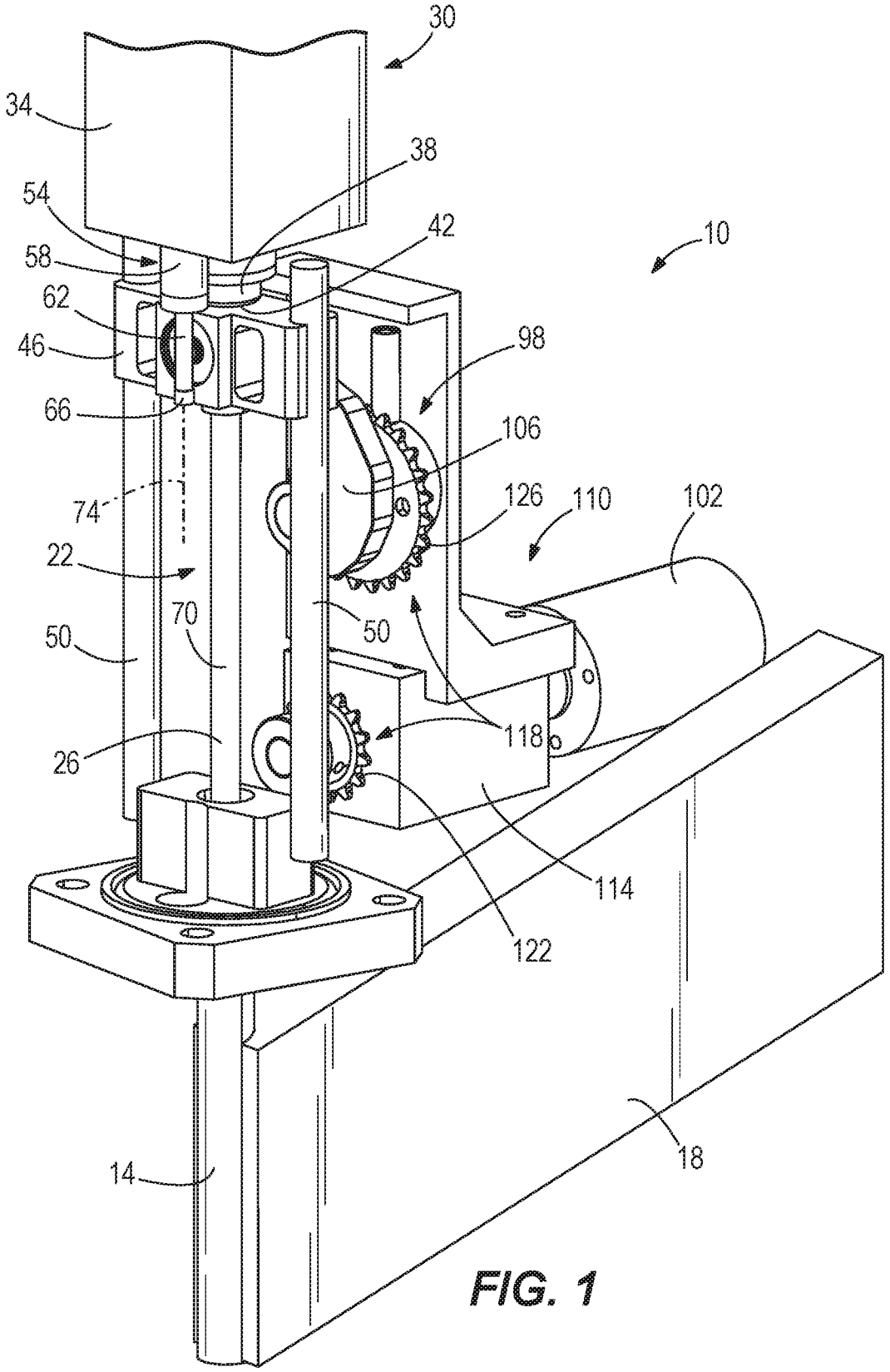
FIG. 1 is a front perspective view of a gas spring fastener driver in accordance with an embodiment of the invention, illustrating a drive blade and a piston of a gas spring mechanism both in a retracted position, just prior to a fastener firing operation.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

With reference to FIGS. 1-7, a gas spring fastener driver 10 for driving fasteners (e.g., nails, tacks, staples, etc.) into a workpiece is shown. The fastener driver 10 includes a main housing 12 (12*a* in FIG. 9), a nosepiece 14 extending from the main housing 12, and a magazine 18 for sequentially feeding collated fasteners into the nosepiece 14 prior to each fastener-driving operation. The fastener driver 10 also includes a drive blade 22, a tip 26 of which is received within the nosepiece 14, and an onboard gas spring mechanism 30 for driving the drive blade 22 from an initial retracted position (shown in FIGS. 1 and 2) toward a driven position coinciding with ejection of a fastener from the nosepiece 14. Accordingly, the fastener driver 10 does not require an external source of air pressure or other external power source for driving the drive blade 22.

With reference to FIG. 1, the gas spring mechanism 30 includes a cylinder housing 34 in which a pressurized gas (e.g., air) is stored and a piston 38 protruding from the cylinder housing 34. The pressurized gas biases the piston 38 toward a driven position (shown in FIGS. 3 and 4) in which it is fully extended from the cylinder housing 34. The piston 38 includes a distal end 42 against which a head 46 of the drive blade 22 is abuttable when the drive blade 22 is in the retracted position (shown in FIGS. 1 and 2). Movement of the drive blade 22 is limited to axial reciprocation, between the retracted position and the driven position, by parallel guide rails 50 along which the head 46 of the drive blade 22 is slidable.

With reference to FIGS. 1-7, the fastener driver 10 also includes an extensible cylinder 54 for raising the drive blade 22 from the driven position toward the retracted position. In the illustrated embodiment of the fastener driver 10, the extensible cylinder 54 includes a cylinder housing 58 affixed to the main housing 12*a* such that the cylinder housing 58 is stationary relative to the main housing 12*a* and the cylinder housing 34 of the gas spring mechanism 30. The cylinder housing 58 of the extensible cylinder 54 may be affixed directly to the cylinder housing 34 of the gas spring mechanism 30, or directly to the main housing 12*a*. Alternatively, the cylinder housing 58 of the extensible cylinder 54 may be affixed to an intermediate component of the fastener driver 10 which, either directly or indirectly, is affixed to the main housing 12*a*. In some embodiments, the cylinder housing 58 may be coupled to the drive blade 22.

The extensible cylinder 54 also includes a rod 62 coupled to the head 46 of the drive blade 22 for movement with the drive blade 22. In the illustrated embodiment of the fastener driver 10, the rod 62 is abutted against a flange 66 (FIG. 1) extending in a lateral direction from a longitudinal axis 70 of the drive blade 22, and secured to the flange 66 using a fastener (e.g., a screw). Alternatively, the rod 62 may be affixed to the head 46 of the drive blade 22 using a welding process, adhesives, an interference fit, or by integrally forming, for example. Accordingly, the rod 62 is axially movable between a retracted positions coinciding with the retracted positions of the piston 38 and the drive blade 22 (shown in FIGS. 1 and 2), and an extended position coinciding with the driven position of the drive blade 22 (not shown). A longitudinal axis 74 of the extensible cylinder 54, therefore, is oriented parallel with the longitudinal axis 70 of the drive blade 22. Alternatively, the rod 62 may be coupled to the main housing 12*a*. Specifically, if the cylinder housing 58 is coupled to one of the main housing 12*a* or the drive blade 22, the rod 62 is coupled to the other of the main housing 12*a* or the drive blade 22. In some embodiments, the orientation of the extensible cylinder 54 may be flipped, such that the cylinder housing 58 may be coupled to the drive blade 22 and the rod 62 may be coupled to the main housing 12*a*.

Figure 8:
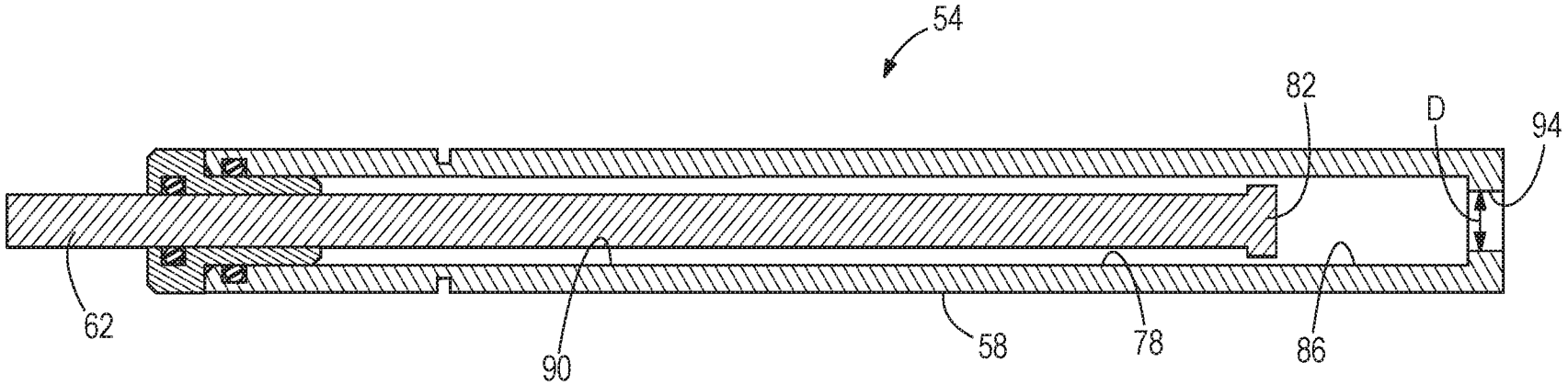
FIG. 8 is a cross-sectional view of an extensible cylinder of the gas spring fastener driver of FIG. 1, illustrating a rod of the extensible cylinder in a retracted position.

With reference to FIG. 8, the cylinder housing 58 of the extensible cylinder 54 includes an interior chamber 78 in which the rod 62 is slidable. The rod 62 includes a piston 82 that divides the interior chamber 78 into a first variable volume region 86 and a second variable volume region 90, the length of each of which is variable and dependent upon the axial position of the rod within the cylinder housing 58. The cylinder housing 58 includes an aperture 94 at one end thereof to fluidly communicate the first variable volume region 86 with an interior of the main housing 12*a*, which is exposed to atmospheric pressure. In the illustrated embodiment of the fastener driver 10, the aperture 94 is coaxial with the rod 62. Alternatively, the aperture 94 may be radially oriented relative to the longitudinal axis 74 of the extensible cylinder 54. The rod 62 extends through the opposite end of the cylinder housing 58, with the second variable volume chamber 90 being exposed to the atmospheric pressure in the interior of the main housing 12*a*.

With continued reference to FIG. 8, the aperture 94 includes a diameter D. During a firing stroke of the drive blade 22 (to which the rod 62 is affixed), the rod 62 is accelerated quickly from its retracted position (shown in FIGS. 1, 2, and 8) toward the extended position, thereby expanding the volume of the first variable volume region 86 in a relatively short time period. The diameter D of the aperture 94 is sized to restrict, but not prohibit, the flow of replacement air into the first variable volume region 86 during this period of expansion. Accordingly, a vacuum (i.e., an absolute pressure less than atmospheric pressure) is created in the first variable volume region 86 as the rod 62 is extended. Because the second variable volume region 90 is exposed to atmospheric pressure, no back-pressure is exerted on the rod 62 during extension.

In another embodiment of the fastener driver 10, a one-way valve (not shown) may be substituted for the aperture 94 to prevent the flow of replacement air into the first variable volume region 86 during extension of the rod 62 relative to the cylinder housing 58, thereby creating a vacuum in the first variable volume region 86. When the rod 62 is retracted into the cylinder housing 58 to the position shown in FIGS. 1 and 2, any pressurized air within the first variable volume region 86 (i.e., air pressurized above atmospheric pressure) is discharged through the aperture 94 and the one-way valve into the interior of the main housing 12*a*. Such a one-way valve may be, for example, a ball check valve.

As is described in further detail below, between two consecutive firing operations of the fastener driver 10, the extensible cylinder 54 returns or raises the drive blade 22 from the driven position (coinciding with ejection of a fastener from the nosepiece 14) to an intermediate position (shown in FIGS. 5-7) between the driven position (not shown) and the retracted position (shown in FIGS. 1 and 2). The fastener driver 10 further includes a lifter mechanism 98, shown most clearly in FIGS. 2, 6, and 7, that completes the return of the drive blade 22 by raising the drive blade 22 from the intermediate position to the retracted position. In the illustrated embodiment of the fastener driver 10, the lifter mechanism 98 includes an electric motor 102 powered by an on-board power source (e.g., a battery), a rotatable cam lobe 106, and a transmission 110 interconnecting the motor 102 and the cam lobe 106. The transmission 110 includes a planetary gear train 114 connected to an output shaft of the motor 102 and an offset gear train 118 connected to the output of the planetary gear train 114. Specifically, the offset gear train 118 includes a small-diameter gear 122 connected with the output of the planetary gear train 114, a large-diameter gear 126 connected with the cam lobe 106, and a chain (not shown) interconnecting the gears 122, 126. Accordingly, torque from the motor 102 is transferred through the planetary gear train 114 and the offset gear train 118, causing the cam lobe to rotate about a rotational axis 130 of the large-diameter gear 126 (FIG. 2).

Figure 2:
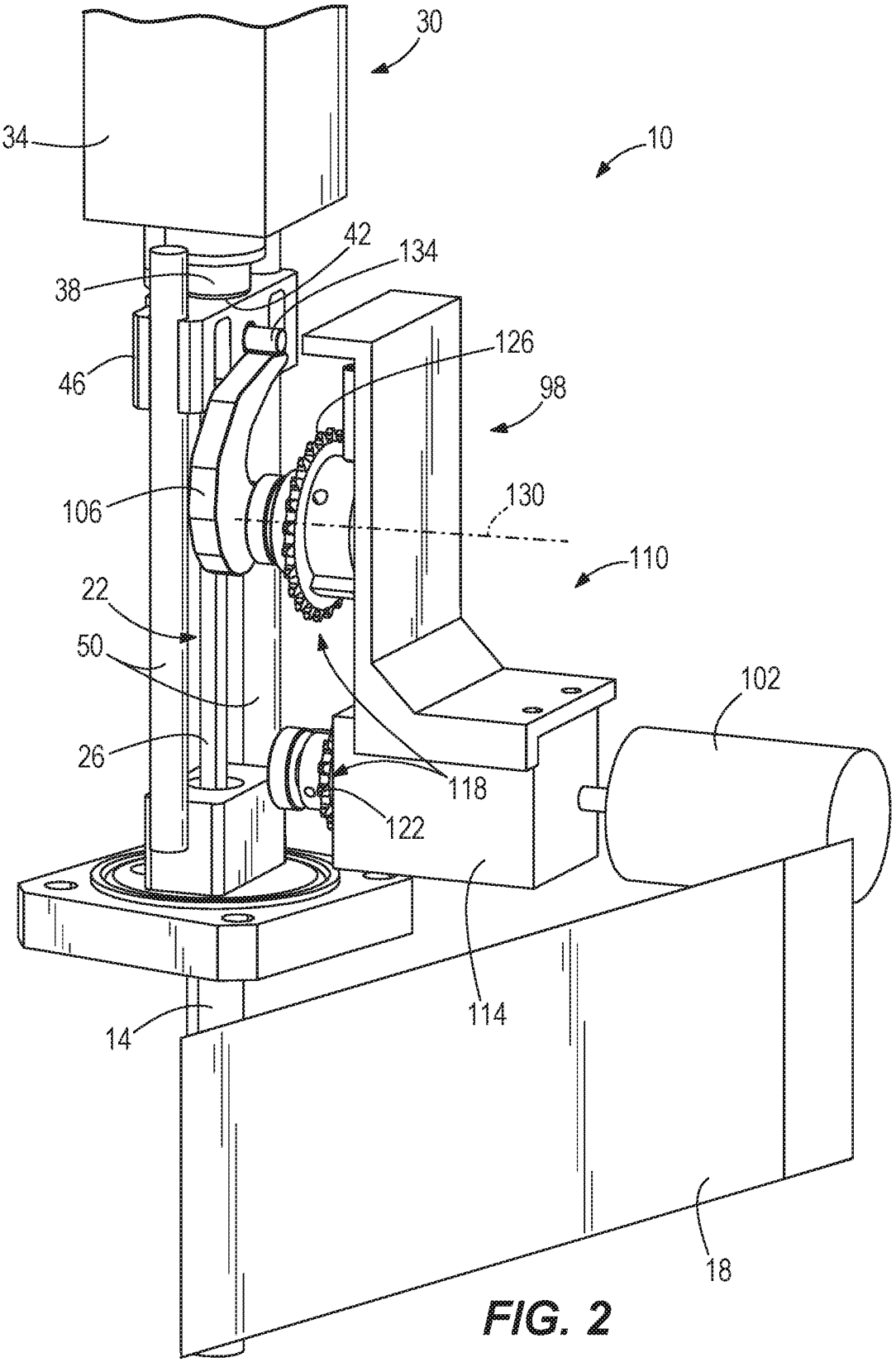
FIG. 2 is a rear perspective view of the gas spring fastener driver of FIG. 1.
Figure 3:
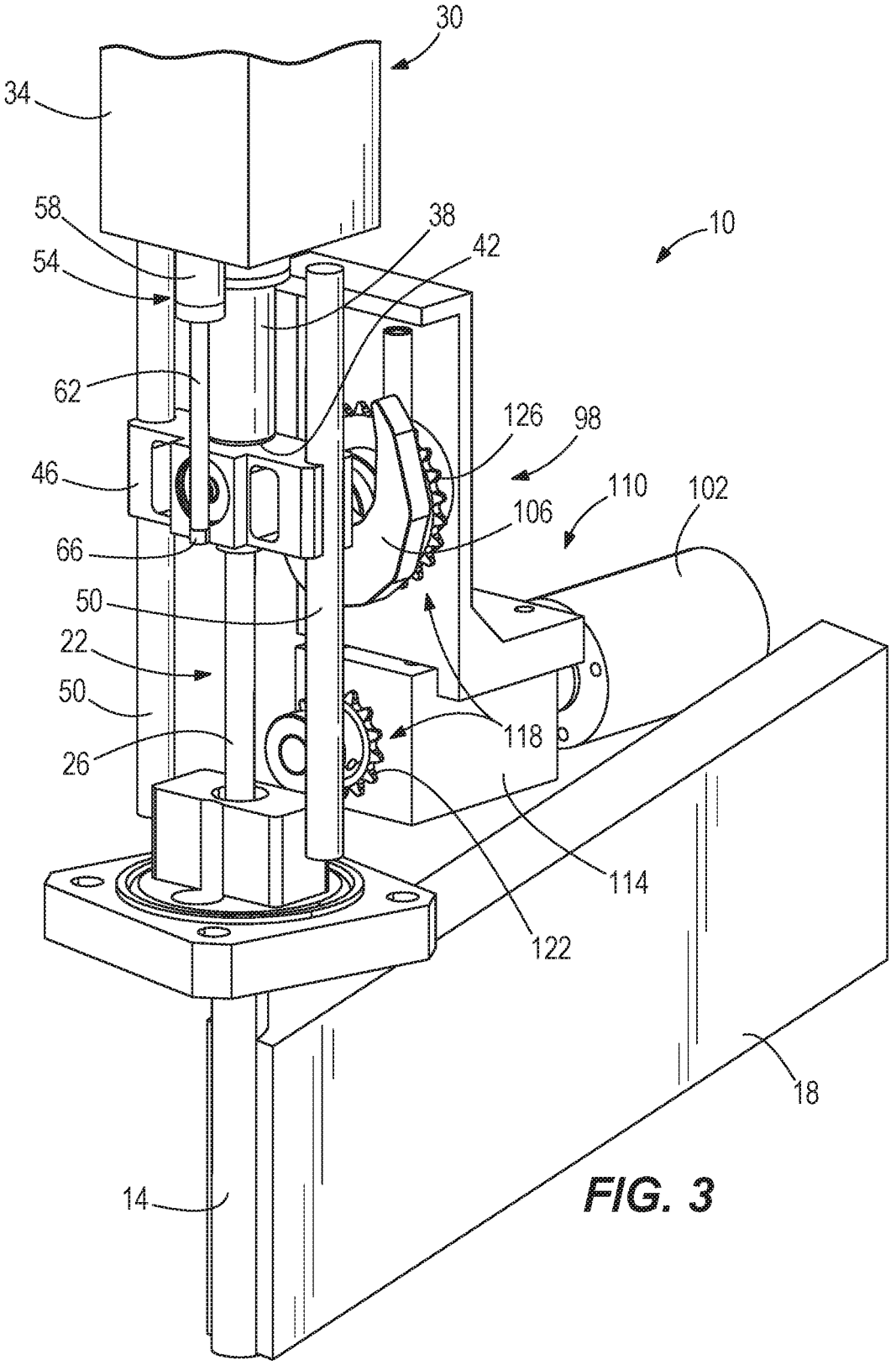
FIG. 3 is a front perspective view of the gas spring fastener driver of FIG. 1, illustrating the drive blade in an intermediate position and the piston in a driven position, just after initiation of a fastener firing operation.
Figure 4:
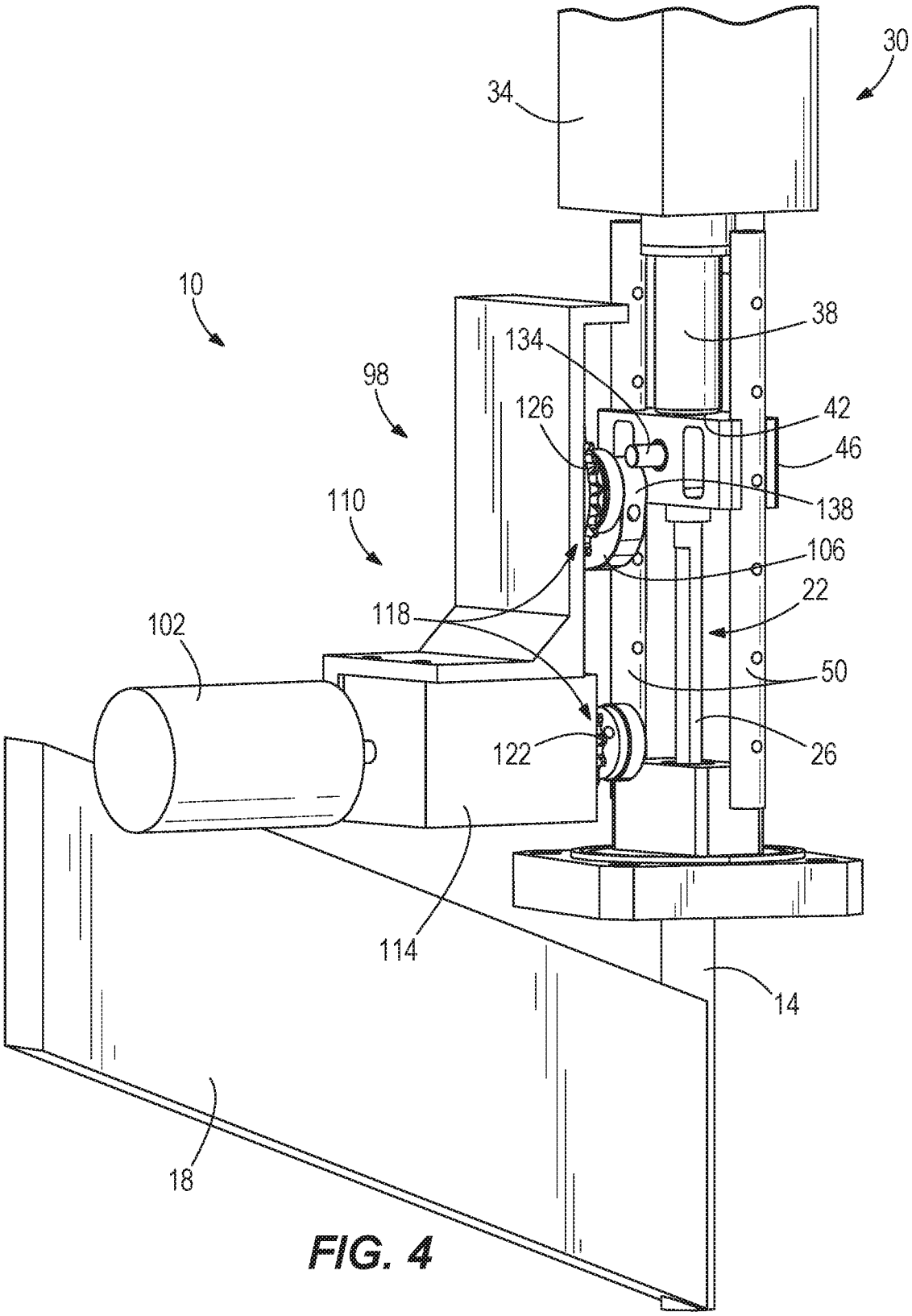
FIG. 4 is a rear perspective view of the gas spring fastener driver of FIG. 3.
Figure 5:
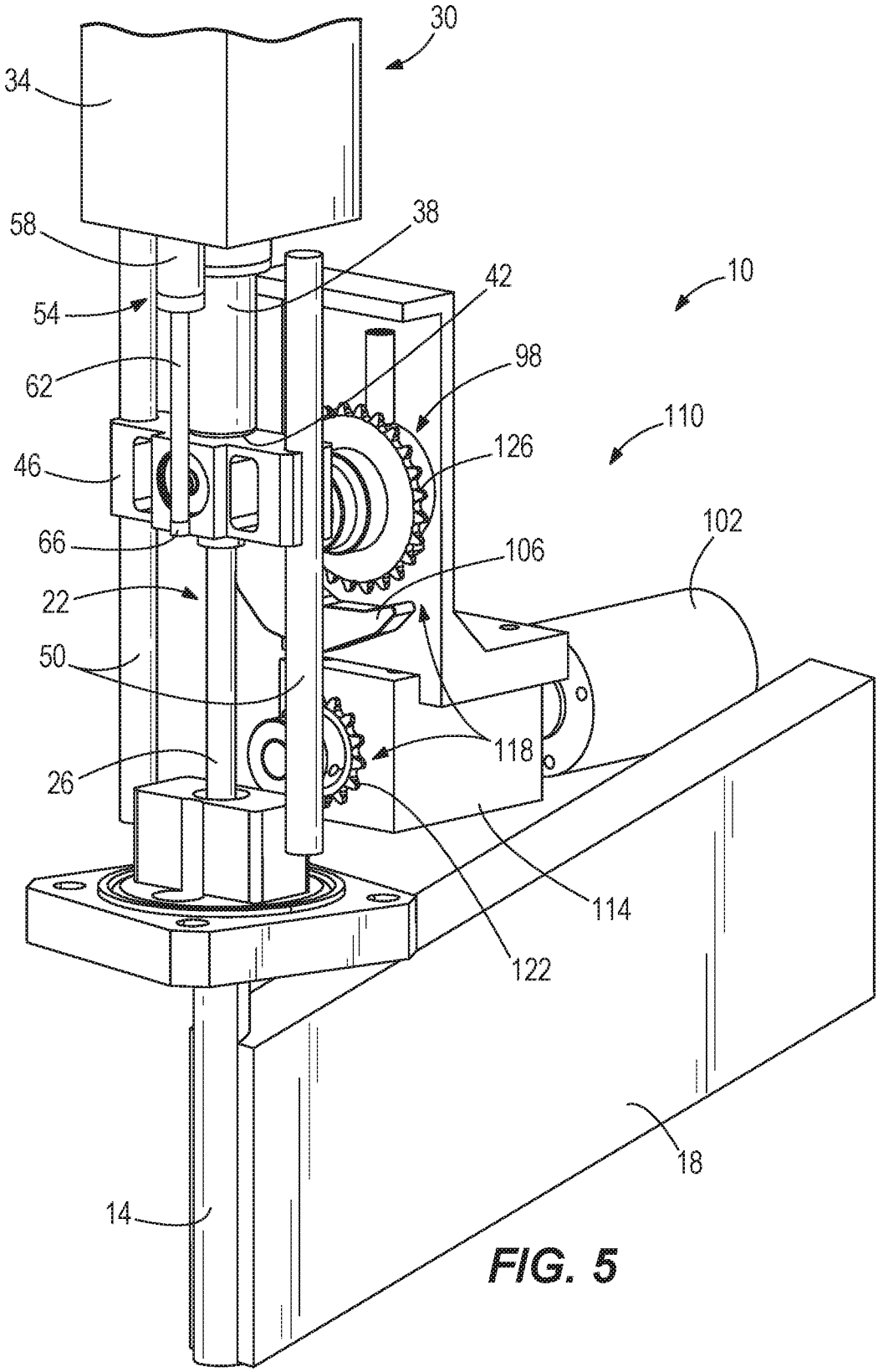
FIG. 5 is a front perspective view of the gas spring fastener driver of FIG. 1, illustrating the drive blade in an intermediate position and the piston in the driven position, after a fastener firing operation and just prior to the drive blade and piston being raised to their retracted positions.
Figure 6:
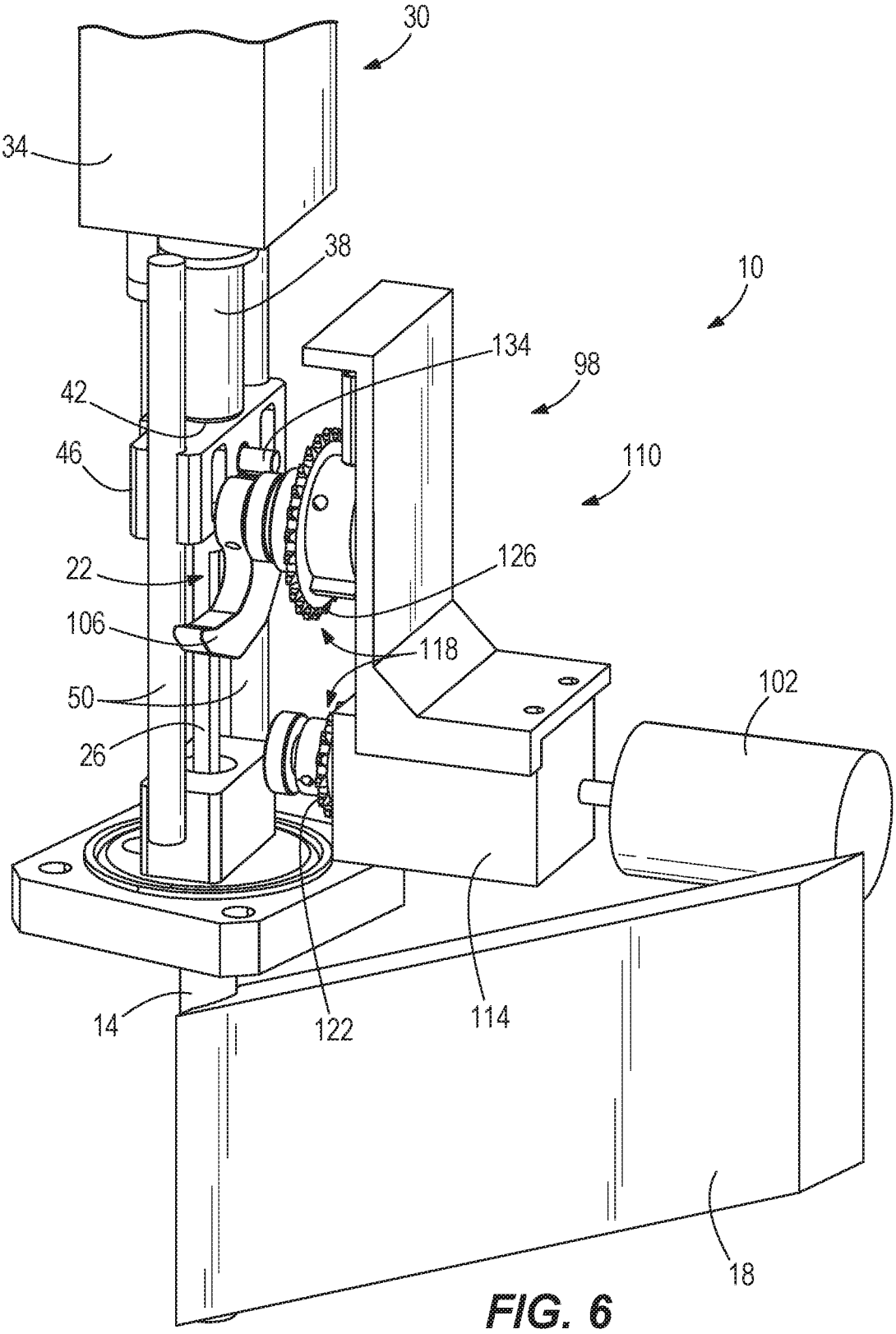
FIG. 6 is a rear perspective view of the gas spring fastener driver of FIG. 5.
Figure 7:
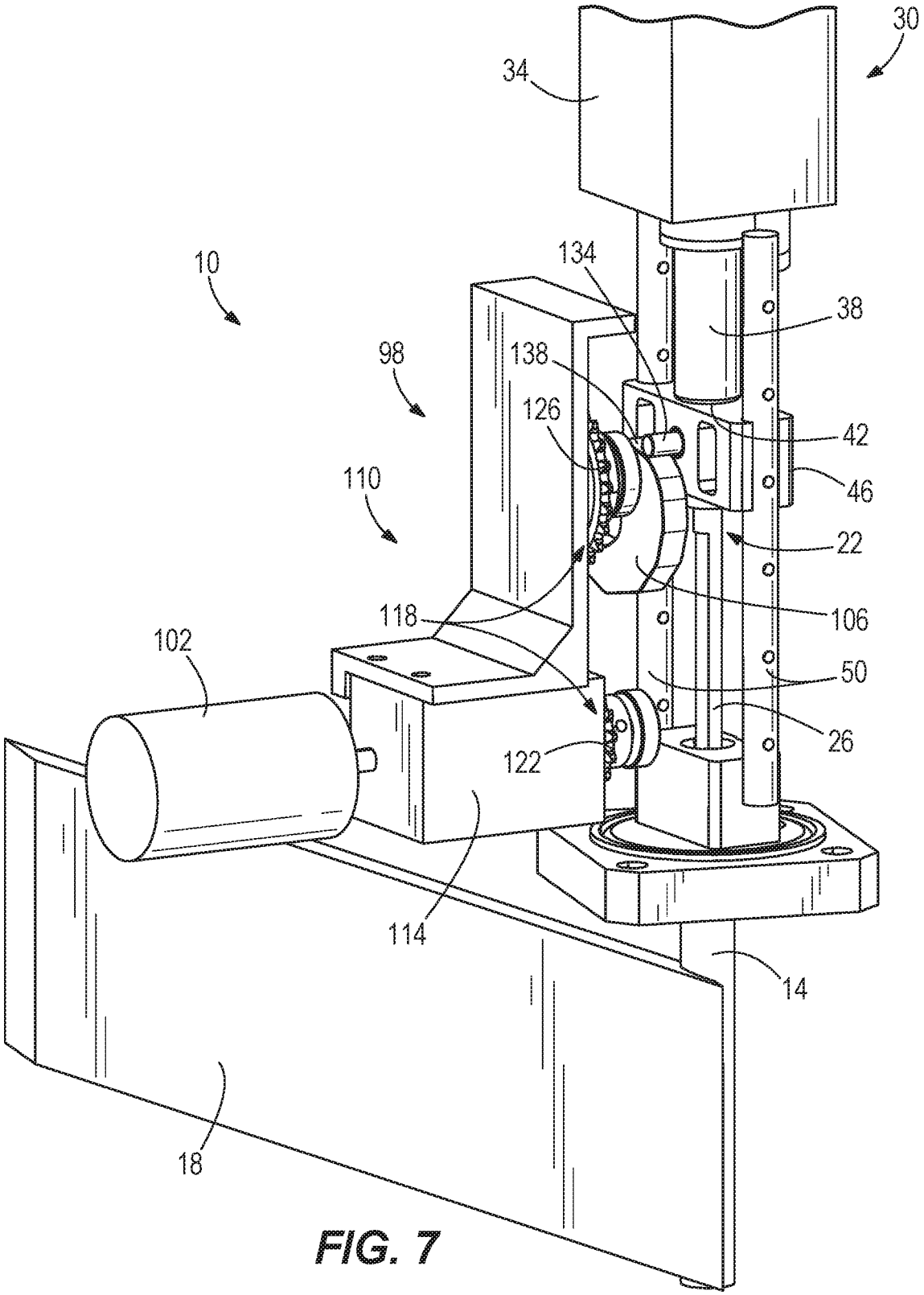
FIG. 7 is another rear perspective view of the gas spring fastener driver of FIG. 5.

With reference to FIGS. 2, 6, and 7, the drive blade 22 includes a follower 134 engaged with the cam lobe 106 while the drive blade 22 is raised from the intermediate position to the retracted position. In the illustrated embodiment of the fastener driver 10, the follower 134 is configured as a cylindrical pin that is slidable along the outer periphery of the cam lobe 106 in response to rotation of the cam lobe 106. Alternatively, the follower 134 may be supported within the head 46 of the drive blade 22 by a bearing, thereby permitting the follower 134 to rotate relative to the head 46. With this arrangement, the follower 134, when configured as a cylindrical pin, may roll along the outer periphery of the cam lobe 106 in response to rotation of the cam lobe 106. Furthermore, the follower 134 protrudes from the head 46 of the drive blade 22 in a lateral direction relative to the longitudinal axis 70 of the drive blade 22, and the cam lobe 106 is positioned between the drive blade 22 and the large-diameter gear 126 of the offset gear train 118.

In operation of the fastener driver 10, a first firing operation is commenced by the user depressing a trigger (not shown) of the fastener driver 10. At this time, the drive blade 22 and the piston 38 are held in their retracted positions, respectively, by the cam lobe 106 (shown in FIGS. 1 and 2). Shortly after the trigger being depressed, the motor 102 is activated to rotate the cam lobe 106 in a counter-clockwise direction about the rotational axis 130 from the frame of reference of FIG. 2. Upon the follower 134 sliding off the tip of the cam lobe 106, the pressurized gas within the cylinder housing 34 expands, pushing the piston 38 outward from the cylinder housing 34 and accelerating the drive blade 22 toward its driven position. The cam lobe 106 is accelerated to a sufficient rotational speed to prohibit subsequent contact with the follower 134 as the drive blade 22 is being driven from its retracted position to the driven position. In addition, the timing of the drive blade 22 reaching its intermediate position coincides with the follower 134 passing alongside a flat segment 138 of the cam lobe 106 (shown most clearly in FIG. 4), thereby creating an unobstructed path for the follower 134 as the drive blade 22 is displaced from its intermediate position toward its driven position (not shown).

After the piston 38 reaches its driven position (shown in FIGS. 3 and 4), the head 46 of the drive blade 22 separates from the distal end 42 of the piston 38 (coinciding with the intermediate position of the drive blade 22), ceasing further acceleration of the drive blade 22. Thereafter, the drive blade 22 continues moving toward its driven position at a relatively constant velocity. Upon impact with a fastener in the nosepiece 14, the drive blade 22 begins to decelerate, ultimately being stopped after the fastener is driven into a workpiece.

During the period of movement of the drive blade 22 from its retracted position (shown in FIGS. 1 and 2) to its driven position (not shown), because the rod 62 of the extensible cylinder 54 is affixed to the head 46 of the drive blade 22 for movement therewith, the rod 62 is also pulled from the cylinder housing 58. As the rod 62 is pulled from the cylinder housing 58, a vacuum is created within the first variable volume region 86 because the rate at which the volume of the first variable volume region 86 expands exceeds the volumetric flow rate of replacement air drawn into the first variable volume region through the aperture to "fill" the expanded volume. After movement of the drive blade 22 is stopped following the conclusion of the first firing operation, a pressure imbalance acting on the rod piston 82 applies a force on the rod 62, causing it to retract into the cylinder housing 58. Because the rod 62 is affixed to the head 46 of the drive blade 22, the drive blade 22 is raised from its driven position toward the intermediate position. At this time, the rotation of the cam lobe 106 is either momentarily stopped or substantially slowed to allow the follower 134 to pass alongside the flat segment 138 of the cam lobe 106 as the drive blade 22 approaches the intermediate position.

Coinciding with the drive blade 22 reaching the intermediate position, rotation of the cam lobe 106 (in the same counter-clockwise direction) is resumed (or alternatively accelerated if previously slowed) to once again contact the follower 134 (shown in FIGS. 6 and 7). As the cam lobe 106 continues its rotation, the follower 134, the drive blade 22, and the piston 38 are displaced upward from the intermediate position of the drive blade 22 shown in FIGS. 5-8 toward the retracted position shown in FIGS. 1 and 2. At this time, the rod 62 is also retracted into the cylinder housing 58, purging air from the first variable volume region 86 to the interior of the main housing 12*a* via the aperture 94. The cam lobe 106 continues to raise the drive blade 22 and the piston 38 until both reach their retracted positions shown in FIGS. 1 and 2, at which time the first firing operation is completed. Thereafter, additional firing operations may be initiated in a like manner.

In an alternative firing cycle, the lifter mechanism 98 may remain deactivated after the extensible cylinder 54 has returned the drive blade 22 to its intermediate position, thereby maintaining the piston 38 in its driven position shown in FIGS. 6 and 7, until the user depresses the trigger to initiate a firing operation. This way, the gas spring mechanism 30 remains in a deactivated state (i.e., with the piston 38 in its biased, driven position) when the fastener driver 10 is not in use.

By providing the extensible cylinder 54 to return the drive blade 22 partially toward its retracted position following each fastener firing operation (i.e., as opposed to using the lifter mechanism 98 to raise the drive blade 22 from its driven position to its retracted position), the cycle time between consecutive firing operations may be reduced, allowing for more rapid placement of fasteners into a workpiece.

Figure 9:
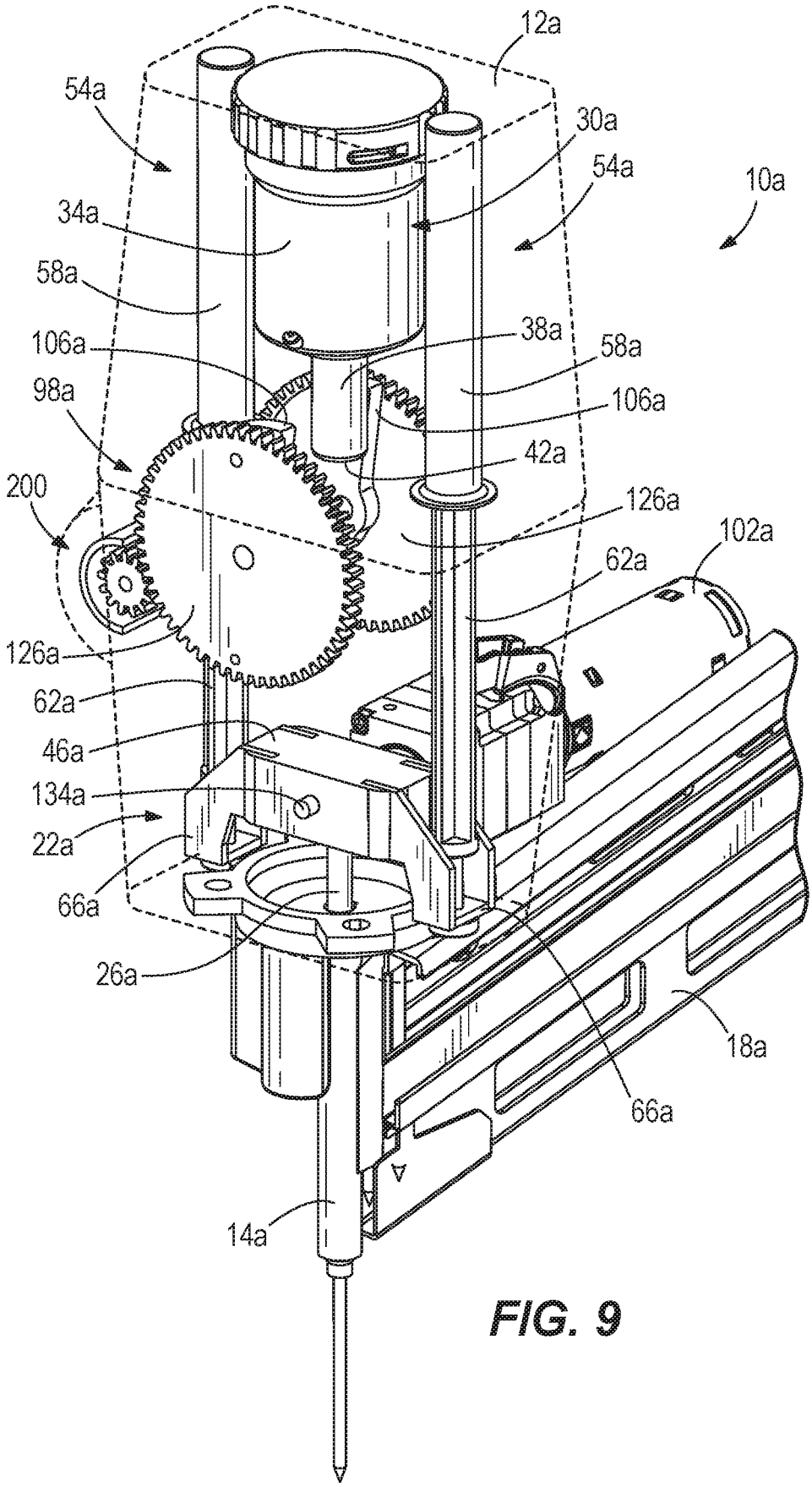
FIG. 9 is a front perspective view of a gas spring fastener driver in accordance with another embodiment of the invention, illustrating a drive blade and a piston of a gas spring mechanism both in a driven position, after a fastener firing operation.
Figure 10:
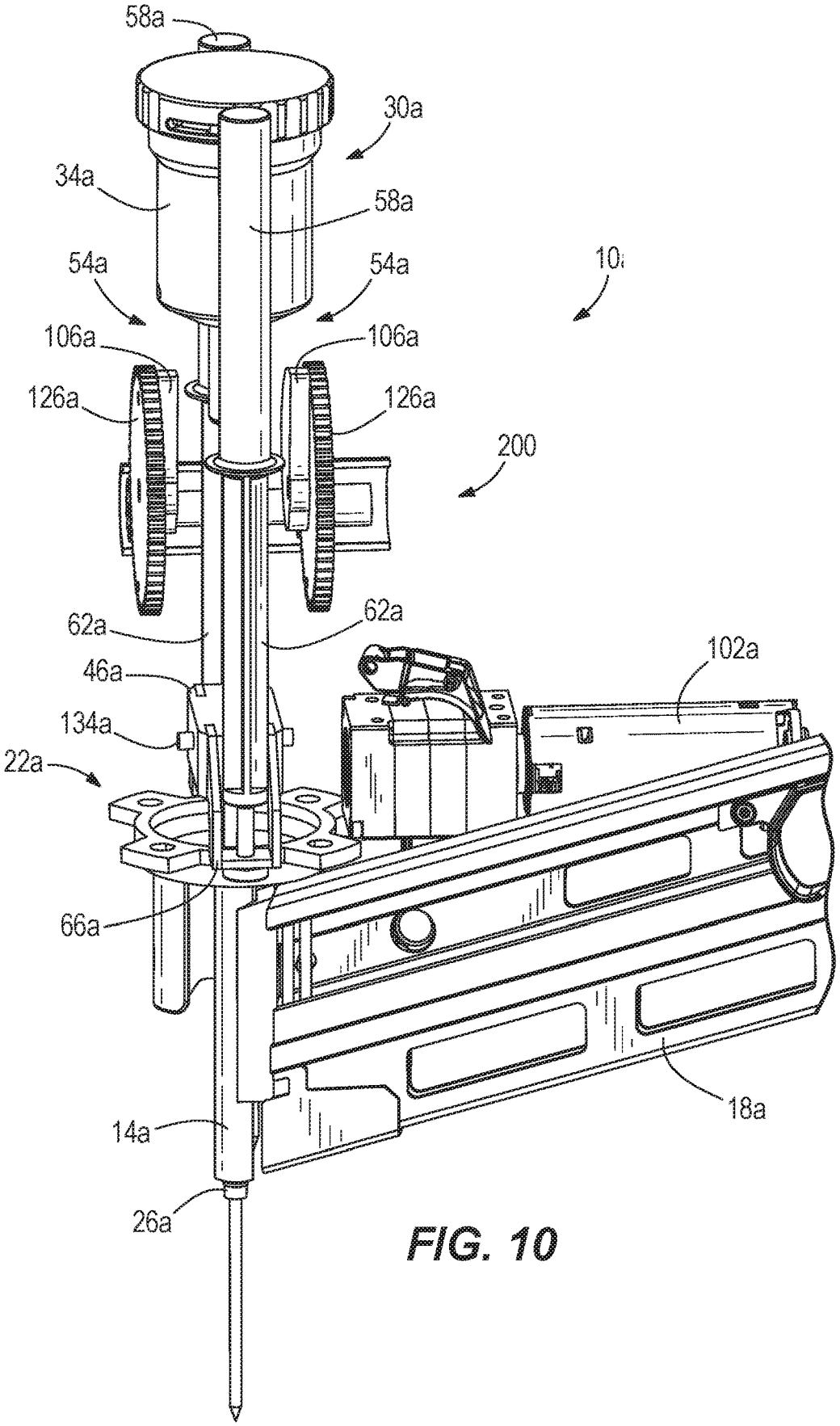
FIG. 10 is a side view of the gas spring fastener driver of FIG. 9.

With reference to FIGS. 9 and 10, another gas spring fastener driver 10*a* for driving fasteners (e.g., nails, tacks, staples, etc.) into a workpiece is shown, with like components as the fastener driver 10 of FIGS. 1-8 being shown with like reference numerals plus the letter "a." Rather than including only a single extensible cylinder, the fastener driver 10*a* includes two extensible cylinders 54*a*, one positioned on each side of the gas spring mechanism 30*a*. And, the rods 62*a* of the respective extensible cylinders 54*a* are affixed to corresponding flanges 66*a* on the head 46*a* of the drive blade 22*a*.

With reference to FIG. 10, the lift mechanism 98*a* includes two cam lobes 106*a* coupled for synchronous co-rotation with respective large-diameter driven gears 126*a* which, in turn, receive torque from the motor 102*a* via a transmission 200. The follower 134*a* protrudes from both the front and rear of the head 46*a* of the drive blade 22*a*, and is engageable by both cam lobes 106*a* for raising the drive blade 22*a* from its intermediate position (as described above) to its retracted position. Otherwise, the fastener driver 10*a* functions identically to the fastener driver 10 as described above.

Various features of the invention are set forth in the following claims.

What is claimed is:

1. A fastener driver comprising:

a main housing;

a drive blade movable from a retracted position to a driven position for driving a fastener into a workpiece;

a gas spring mechanism for driving the drive blade from the retracted position to the driven position, the gas spring mechanism including a piston movable between a retracted position and a driven position; and an extensible cylinder separate from the gas spring mechanism for moving the drive blade from the driven position toward the retracted position, wherein the extensible cylinder includes a cylinder housing coupled one of the main housing or the drive blade, and a rod coupled to the other of the main housing or the drive blade;

wherein a vacuum is created in the cylinder housing for biasing the drive blade toward the retracted position.

2. The fastener driver of claim 1, wherein the vacuum in the extensible cylinder moves the drive blade from the driven position to an intermediate position between the driven position and the retracted position.

3. The fastener driver of claim 2, further comprising a lifter mechanism that raises the drive blade from the intermediate position to the retracted position.

4. The fastener driver of claim 3, wherein the lifter mechanism raises the drive blade and the piston of the gas spring mechanism to the retracted position of the drive blade and the piston, respectively.

5. The fastener driver of claim 4, wherein the lifter mechanism includes a cam lobe, and wherein the drive blade includes a follower engaged with the cam lobe while the drive blade is raised from the intermediate position to the retracted position.

6. The fastener driver of claim 5, further comprising an electric motor for rotating the cam lobe.

7. The fastener driver of claim 6, further comprising a battery for supplying power to the electric motor.

8. The fastener driver of claim 1, wherein the cylinder housing is coupled to the main housing and is stationary relative to the main housing.

9. The fastener driver of claim 8, wherein the rod is coupled to the drive blade for movement therewith between the retracted position and the driven position.

10. The fastener driver of claim 1, wherein the cylinder housing includes an interior chamber in which the rod is slidable, wherein the rod includes a piston that divides the interior chamber into a first variable volume region and a second variable volume region, and wherein the cylinder housing includes an aperture at one end thereof fluidly communicating one of the first or second variable volume regions with an interior of the main housing.

11. The fastener driver of claim 10, wherein the interior of the main housing is at atmospheric pressure.

12. The fastener driver of claim 10, wherein the aperture is positioned in a first end of the cylinder housing to fluidly communicate the first variable volume region with the interior chamber of the main housing, and wherein the cylinder housing includes a second end through which the rod extends.

13. The fastener driver of claim 12, wherein the aperture is coaxial with the rod.

14. The fastener driver of claim 12, wherein the rod is coupled to the drive blade for movement therewith, and wherein the rod moves with the drive blade as the drive blade is driven from the retracted position to the driven position.

15. The fastener driver of claim 14, wherein the vacuum is created in the first variable volume region in response to extension of the rod from the cylinder housing as the drive blade is driven from the retracted position to the driven position.

16. The fastener driver of claim 15, wherein the vacuum in the first variable volume region moves the drive blade from the driven position to an intermediate position between the driven position and the retracted position.

17. The fastener driver of claim 16, further comprising a lifter mechanism that raises the drive blade from the intermediate position to the retracted position, wherein the rod is retracted into the cylinder housing simultaneously as the drive blade is raised by the lifter mechanism from the intermediate position to the retracted position.

18. The fastener driver of claim 17, wherein air within the first variable volume region is purged from the aperture as the rod is retracted into the cylinder housing.

19. The fastener driver of claim 14, further comprising a one-way valve adjacent the aperture to prevent a flow of replacement air in a first direction through the aperture and into the first variable volume region, and permit an airflow in an opposite, second direction through the aperture.

20. The fastener driver of claim 1, wherein the gas spring mechanism includes a gas spring cylinder housing in which a pressurized gas is stored, and wherein the pressurized gas biases the piston toward the driven position.

21. The fastener driver of claim 1, wherein the piston is separable from the drive blade upon the piston reaching the driven position.

* * * * *